United States Patent [19]

Bradshaw

[11] Patent Number: 4,749,176

[45] Date of Patent: Jun. 7, 1988

[54] DEVICE FOR RETAINING A COMPRESSION MEMBER AGAINST A WALL COVERING

[76] Inventor: Larry R. Bradshaw, 16305 Knottingham, Pfluegerville, Tex. 78753

[21] Appl. No.: 888,031

[22] Filed: Jul. 18, 1986

[51] Int. Cl.[4] ..... B25B 5/14

[52] U.S. Cl. ..... 269/41; 269/904

[58] Field of Search ..... 269/41, 42, 154, 155, 269/104, 110, 152, 153, 904; 52/702

[56] References Cited

U.S. PATENT DOCUMENTS

| | | | |
|---|---|---|---|
| 2,606,583 | 8/1952 | O'Connor | 269/41 |
| 2,911,022 | 11/1959 | Brown | 269/41 |
| 4,165,869 | 8/1979 | Williams | 269/41 |
| 4,281,826 | 8/1981 | Calvert | 269/41 |
| 4,385,755 | 5/1983 | Mawer | 269/41 |
| 4,541,618 | 9/1985 | Bruno | 269/41 |

*Primary Examiner*—Robert C. Watson
*Attorney, Agent, or Firm*—John M. Harrison

[57] ABSTRACT

A device for retaining a compression member in compression against a wall covering during installation where adhesive is used. The device can be used in interior or exterior applications with all types of wall coverings such as plasterboard or wallboard, vinyl-covered wallboard, layered or laminated wallboard, paneling, Sheetrock, veneers, or any type building product installed to wall framework or an existing wall surface. The device includes a base adapted to be securable to a fixed surface, an alignment means secured to the base for aligning the compression member against the wall covering, and a retaining means secured to the base for retaining the compression member in compression against the wall covering.

4 Claims, 3 Drawing Sheets

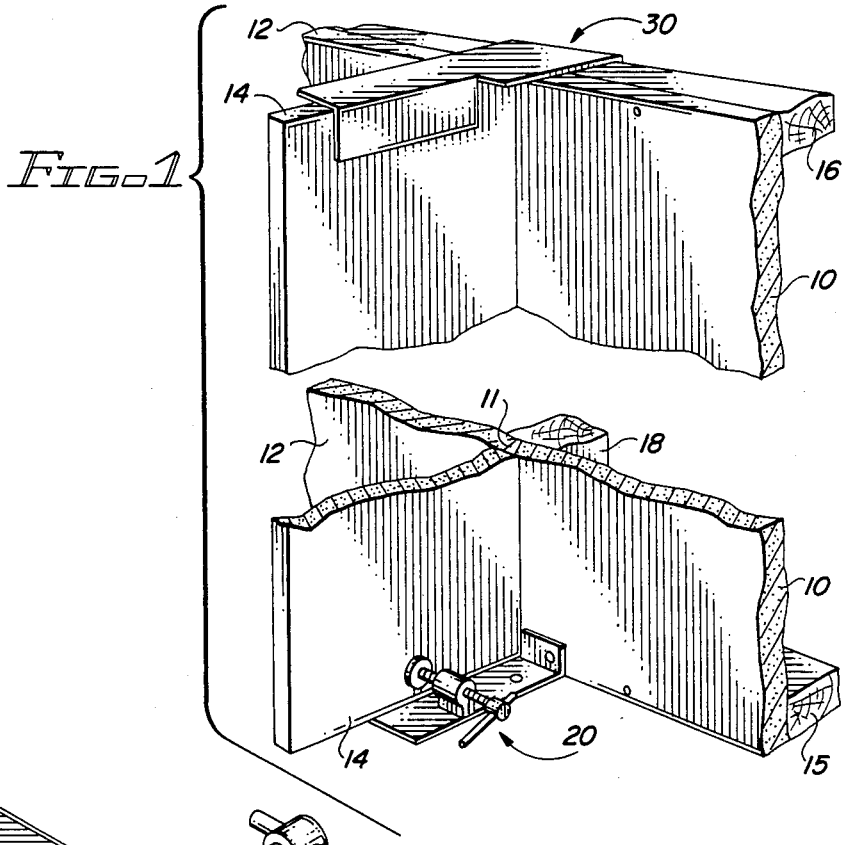
FIG. 1
FIG. 2
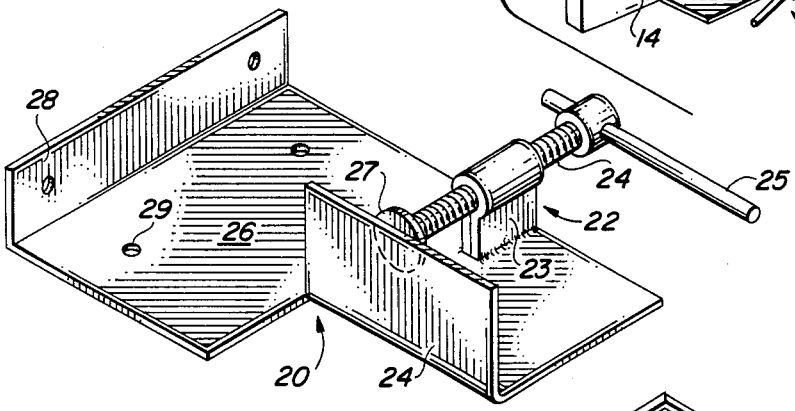
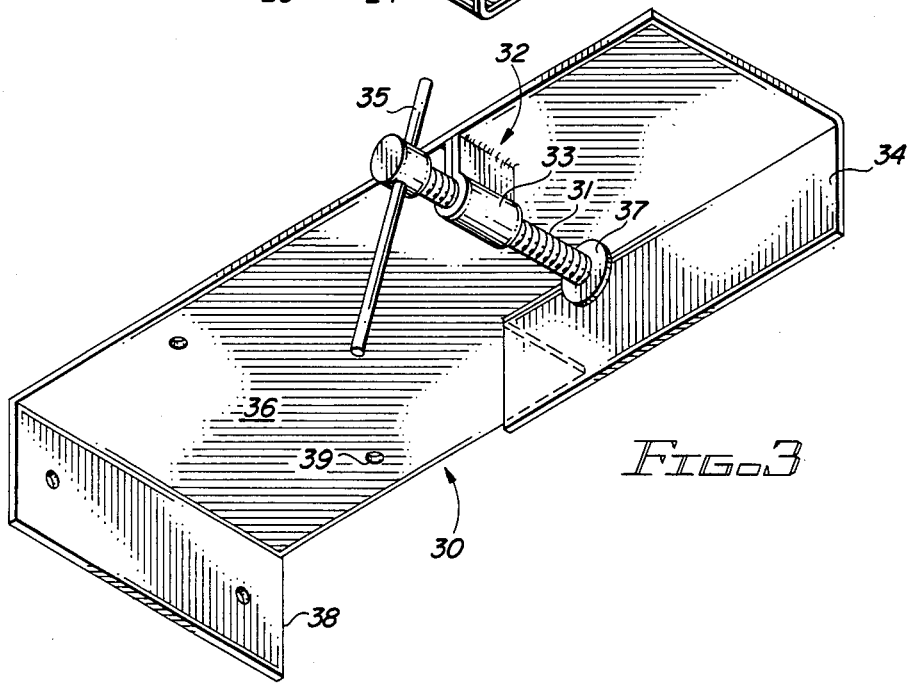
FIG. 3

DEVICE FOR RETAINING A COMPRESSION MEMBER AGAINST A WALL COVERING

BACKGROUND OF THE INVENTION

1. Field of the Invention

The present invention relates generally to devices utilized to assist in the installation of wall coverings such as Sheetrock, paneling or other wallboard. More specifically, the invention relates to a device for retaining a compression member against a wall covering during installation to accommodate the fastening of the wall covering to the wall framework or a wall surface by an adhesive or similar fastening means.

2. Description of the Relevant Art

Many methods and devices are used to install wall coverings. Perhaps the most common method is to nail the wall covering to a frame. for wall covering installations which are to be taped and floated, this method requires a great number of nails and a significant effort to hide all of the nail heads. If the wall covering is a finished wall covering wherein the nails will not be floated, then colored nails or colored pins are necessary to prevent an unsightly appearance due to the presence of visible nails. In addition, care must be taken to align the nailing sites for a uniform appearance. Nailing therefore requires greater time and effort in installation and presents the possibility of an unsightly appearance. As a result, alternatives to nailing are often employed.

One alternative to totally nailing a wall covering involves the use of a combination of adhesive and nailing. Typically, in this method, the top and bottom of a wall covering are nailed to the wall framework and adhesive is used to hold the remainder of the wall covering in place. The adhesive may be applied to the wall framework or the wall covering itself. Unless molding or baseboards are to be used, colored nails or colored pins should be used to prevent an unsightly appearance due to the presence of visible nails. In addition, the wall covering must be bowed or warped to provide pressure at the center of the board during adhesive curing. If the wall covering is not properly bowed or warped, temporary bracing is required to insure proper bonding of the wall covering to the framework of the wall.

Bowing or warping of a wall covering is accomplished by stacking the wall covering on blocks such that a bow or warp is created. When properly bowed or warped, the wall covering will push away from the top and bottom when installed. When the top and bottom of the wall covering are nailed into place, pressure will then be exerted due to the warp on the center of the wall covering and hence the adhesive. Bowing or warping can take one or more days and is thus a time consuming and expensive process, especially where the wages of workers are concerned. In addition, bowing or warping requires additional handling of the wall covering material which presents greater opportunity for damage or delay. Further, wall coverings that are bowed tend to create seams or joints that are not even due to uneven bowing or alignment. Finally, even where bowing of the wall covering is accomplished, additional bracing may be necessary to ensure proper contact during adhesion.

Another alternative method to nailing a wall covering is lamination of the wall covering to an existing wall. This method is similar to installation involving the use of adhesive and nails to attach a wall covering to wall framework, and similar drawbacks are present.

This method also requires bowing or warping of the wall covering for proper wall contact and pressure on the adhesive, or the use of temporary bracing during installation.

Still another alternative method presently used for the installation of wall coverings involves the use of stud ties. The use of stud ties requires the drilling of holes in metal studs. The stud tie includes a plastic guide with integral wires extending from the guide. The wires are pushed through the holes in the metal studs from the inside and are twisted to engage the wall covering. This method is time consuming and presents the opportunity for damage to the wall covering, especially during twisting of the wires to tighten the assembly. Adhesive is often used with this method to better secure the wall covering.

Yet another method that is often used to install wall coverings utilizes edge grip clips for installation. An edge grip clip is first tapped into the edge of the wall covering. The edge grip clip includes a slot for receiving a fastener which extends from the portion of the clip tapped into the wall covering. When the wall covering is placed along the studs, it is then necessary to fasten the edge grip clip to the stud. As can be appreciated, this method is time consuming and requires drilling where screws are to be employed. Further, the edge grip clips raise the edges of the wall covering, causing the seams between adjoining wall coverings to be higher than the centers.

The use of adhesive in the installation of wall coverings offers numerous advantages over nailing or the use of permanent fasteners such as stud ties and edge grip clips. For example, less time and labor are required, and appearance is enhanced by minimizing or eliminating visible fasteners. In addition, the use of adhesive strengthens the overall wall structure. When taping and floating finishing is used on a wall covering, the reduction of fasteners allows finishing to be simplified and to be accomplished in less time. Further, where studs do not suitably align with the edges of a wall covering, often the studs are twisted to provide an attachment surface for the wall covering. This twisting causes a misalignment in the edge of a joining wall covering. The use of adhesive allows a minimum stud contact to be used and thus reduces the need for twisting of the studs.

As described above, however, the use of adhesive typically includes bowing or warping the wall covering prior to installation to insure that sufficient contact between the supporting stud wall and the wall covering is maintained while the adhesive sets. And, as stated above, additional bracing is often necessary to insure proper contact.

It is therefore desirable to provide a device which quickly and simply provides a means of holding a wall covering to a wall surface or wall framework while the adhesive sets. Such a device should be capable of being easily put into place and removed once installation is completed. The device should also lessen the labor demands currently encountered with the present methods of bowing and warping and sometimes bracing the wall covering.

SUMMARY OF THE INVENTION

The device of the present invention eliminates the need for time consuming installation involving the use of permanent fasteners and eliminates the need for bowing or warping the wall covering prior to installation where adhesive is to be employed. The device of the present invention is simple and easy to use and is designed to support a wall covering in place until an adhesive sets. The device of the present invention is also more economical to use in the installation of wall coverings primarily due to the reduction in time and materials necessary for installation.

More particularly, the present invention provides a device for retaining a compression member in compression against a wall covering during installation. The device can be used in interior or exterior applications with all types of wall coverings such as plasterboard or wallboard, vinyl-covered wallboard, layered or laminated wallboard, paneling, Sheetrock, veneers, or any type building product installed to wall framework or an existing wall surface. The device includes a base adapted to be securable to a fixed surface, an alignment means secured to the base for aligning the compression member against the wall covering, and a retaining means secured to the base for retaining the compression member in compression against the wall covering.

In a preferred embodiment of the device of the present invention, the device includes a base having an abutment edge which contacts the wall covering in place. The base or the abutment edge may include holes for receiving a fastener such as a screw or nail to secure the base in place during use to a fixed surface such as the wall framework, ceiling, or floor. Alternately, the base may be securable to a fixed surface through the inclusion of a slip-resistant bottom for frictionally engaging a fixed surface. An alignment guide is provided having an alignment surface disposed to align the compression member against the wall covering. A retaining means, such as a clamping member or end stop, is secured to the base which retains the compression member against the alignment guide and allows the compression member to exert pressure against the wall covering.

The compression member contemplated for use in connection with the present invention may be a member of any suitable size or shape, preferably sufficient in size to exert pressure along the area of the wall covering to be installed with adhesive. As a practical matter, because of the versatile nature of the present invention, the compression member may be a spare section of wall covering or scrap present at the job site.

BRIEF DESCRIPTION OF THE DRAWINGS

The invention will further be illustrated by reference to the appended drawings which illustrate particular embodiments of the device for retaining a compression member against a wall covering during installation in accordance with this invention.

FIG. 1 is a perspective view in partial section illustrating placement of the device of the present invention at the upper and lower ends of a wall covering in accordance with the present invention.

FIG. 2 is a perspective view of a lower device for use at a lower end of a wall covering in accordance with the present invention utilizing a clamping member including a compression screw as a retaining means.

FIG. 3 is a perspective view of an upper device in accordance with the present invention utilizing a clamping member including a compression screw as a retaining means.

DESCRIPTION OF THE PREFERRED EMBODIMENTS

Figure 4:
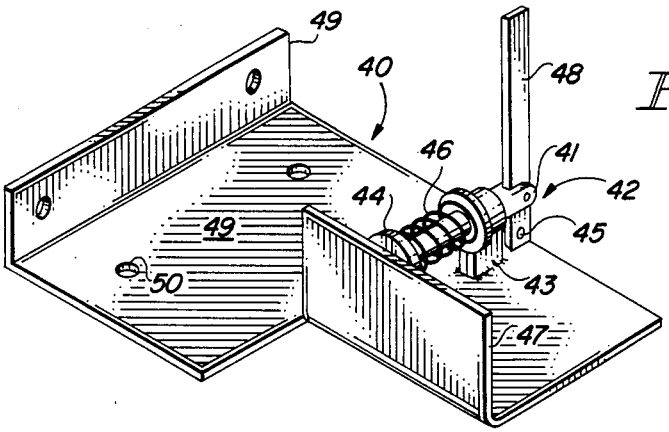
FIG. 4 is a perspective view of a device in accordance with the present invention utilizing a clamping member including a spring as a retaining means.

It will be understood that the present invention can be implemented in a number of different ways within the scope of the claims appended hereto. The presently preferred embodiments of the invention will now be described.

Turning now to the drawings, FIG. 1 illustrates the use of a lower device 20 and an upper device 30 in accordance with the present invention to retain a compression member 14 against a seam 11 between wall coverings 10 and 12 to hold the wall coverings 10 and 12 against a stud 18 for adhesion. Devices 20 and 30 are particularly effective when used at joints or seams between wall coverings and may also be suitably employed to hold a compression member against any portion of the wall covering. Devices 20 and 30 will be more fully described with reference to further drawings.

FIG. 2 illustrates a lower device 20 for retaining a compression member against a wall covering during installation in accordance with the present invention. As shown, device 20 includes a base 26 and a retaining means 22 secured to the base 26. Retaining means 22 as shown is a compression screw which includes a tightening lever 25, a screw 21, a screw retaining post 23 and a contact surface 27. The device 20 further includes an alignment guide 24 and an abutment edge 28. The alignment guide 24 defines an alignment surface disposed to align a compression member in relation to the wall covering to which pressure is to be applied. An abutment edge 28 may or may not be provided to the device 20. If provided, the abutment edge 28 abuts the wall covering or coverings and can be used to align the base 26 with respect to the wall. The abutment edge 28 may also be notched so that the compression member will be in direct contact with the wall covering at the base. The base 26 and the abutment edge 28 may further include one or more holes 29 for receiving a fastener such as nails, screws, brads or the like to secure the device 20 to a fixed surface during use. Fixed surfaces which are typically available include the wall framework or stud wall, the ceiling, the floor, or a portion of the wall covering itself which may already be fastened in place. Often times, the upper and lower portions of a wall covering are nailed into place during installation and thus provide fixed surfaces for the securing of the device 20.

In use, the device 20 is placed adjacent a wall covering or a seam in wall coverings which are to be installed using an adhesive. If an abutment edge 28 with holes 29 is provided on the device 20, the device 20 may be secured to a stud wall by a fastener. If no abutment edge is provided, device 20 may also be secured in position through the use of a fastener through holes 29 in the base 26. Alternatively, the device 20 may include a slip-resistant bottom for frictionally engaging a fixed surface to secure device 20. With or without holes, the abutment edge 28 can be used to align the device 20 with respect to the wall covering. A compression member is then placed against the wall covering and against the alignment guide 24. The compression member may be any member of a suitable size and shape to contact the portion of the wall covering to be secured. Often, spare wall covering material or scrap is present at the job site and can be employed for this purpose. The compression member once aligned, is then pressed against the wall covering as the compression screw 22 is tightened. After tightening, the compression screw 22 retains the compression member in contact with the wall covering under pressure. Once the adhesive has cured, the device 20 may be removed and reused.

FIG. 3 illustrates the orientation of an embodiment of an upper device 30 for retaining a compression member against a wall covering in accordance with the present invention. The device 30 shown in FIG. 3 is essentially identical to the lower device 20 shown in FIG. 2, and includes a base 36, an abutment edge 38, an alignment guide 34 and a retaining means 32. The retaining means 32, as shown, is a compression screw which includes a tightening lever 35, a screw retaining post 33, a screw 31 and a contact surface 37. As discussed above in connection with the lower device 20, the upper device 30 may further include one or more holes 39 for receiving fasteners for securing the device 30 in place during use. The upper device 30 differs from the lower device 20 only in respect that device 30 has a longer base 36, thereby enabling the device 30 to engage the framework (the stud wall) of the wall. This is perhaps best illustrated in FIG. 1, wherein the device 30 engages a frame member 16 by the inside of the abutment edge 38 to hold the device 30 in place during use. It is not necessary that an abutment edge 38 be provided nor is it necessary that the device 30 engage a frame member 16. A lower clamp could successfully be employed in the upper position provided the device can be secured to a fixed surface such as a fixed position of the wall covering, the ceiling, or a frame member.

The retaining means shown and discussed in connection with devices 20 and 30 of FIGS. 2 and 3 above is a compression screw. It should be apparent from the present disclosure, however, that numerous types of retaining means may be suitably employed within the scope of the present invention. A mechanical retaining means may include a clamping member screwed to the base opposite the alignment guide such that adjustable movement of the clamping member towards and away from the alignment surface is provided in order to retain the compression member. In the case of the compression screw, the clamping member is the screw with the contact surface which is adjustable by twisting the screw to retain a compression member. Nonmechanical retaining means may also be employed such as an end stop or serrations as will be further discussed below.

FIG. 4 illustrates a device 40 for retaining a compression member against a wall covering in accordance with the present invention. The device 40, as shown, includes a base 48, an alignment guide 47, an abutment edge 49 and may include one or more holes 50 for receiving fasteners. The device 40 further includes a retaining means 42 having a clamping member including a spring. As shown, the retaining means 42 includes a post 43, a spring 46, a contact surface 44 and a lever 48. The lever 48 is movably secured to the base 48 at the pin 45. Similarly, the lever 48 is movably secured at the pin 41 to the contact surface 44. When the lever 48 is pulled back, the contact surface 44 will be moved away from the alignment guide 47 thereby allowing a compression member to be inserted therebetween. Once the compression member is placed between the alignment guide 47 and the pin 41, the lever 48 is released and the compression member is aligned in place and retained by the force of spring 46.

Figure 5:
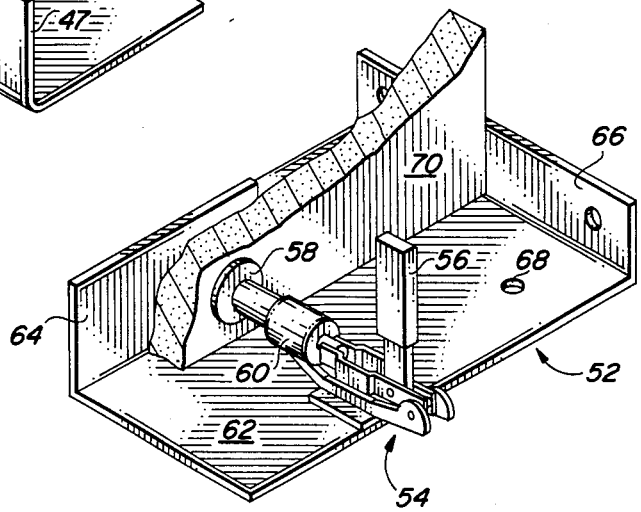
FIG. 5 is a perspective view of a device in accordance with the present invention utilizing a clamping member including a compression clamp as a retaining means.

FIG. 5 depicts a device 52 for retaining a compression member against a wall covering in accordance with the present invention utilizing a retaining means having a clamping member which includes a compression clamp. The device 52 includes a base 62, an alignment guide 64, an abutment edge 66 and a compression clamp 54. As shown, the compression clamp 54 is utilized to retain the compression member 70. The compression clamp 54 includes a lever 56, a contact portion 58 and a piston 60. The device 52 may also include one or more holes 68 in the base 62 or the abutment edge 66 for receiving a fastener and may include a slip-resistant bottom to secure the base 62 to a fixed surface.

Figure 6:
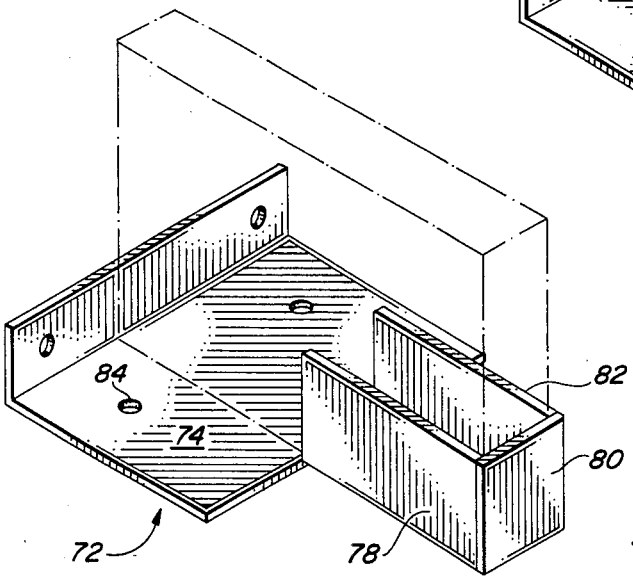
FIG. 6 is a perspective view of a device in accordance with the present invention utilizing an end stop retaining means.

FIG. 6 illustrates a device 72 in accordance with the present invention. The device 72 includes a base 74, an abutment edge 76, alignment guides 78 and 82 and an end stop 80. As shown, the end stop 80 is used to retain a compression member shown in dashed lines. As can be appreciated, the device 72, if used with an abutment edge 76, requires the use of a selectively sized compression member. However, if the abutment edge 76 is removed, a compression member of virtually any size can be used by securing the base 74 at a point away from the wall covering which allows the compression member to contact the wall covering.

Figure 7:
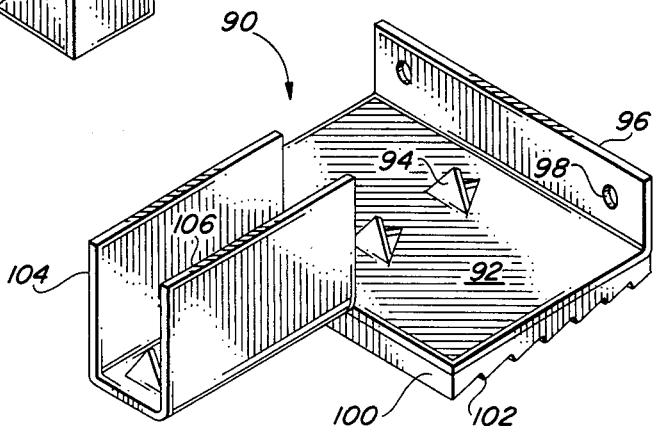
FIG. 7 is a perspective view of a device in accordance with the present invention utilizing serrations for retaining means and having a base with a slip-resistant bottom.

FIG. 7 illustrates a device 90 in accordance with the present invention. The device 90 includes a base 92, an abutment edge 96 and alignment guides 104 and 106. As a retaining means for the compression member, device 90 employs serrations 94 to engage the compression member. The serrations 94 extend upwardly from the base 92 and may be employed in any of the devices made in accordance with the present invention. Further, the serrations 92 may be in a greater or lesser number, depending upon the particular application, and may be used in both upper and lower devices. As can be appreciated, the compression member is retained by the serrations 94 in relation to the wall covering to be retained. Again, the abutment edge 96 is optional and may be used where it is desired to secure the device to the wall or wall covering during use.

The size of the gap between alignment guides 104 and 106 can be varied to accommodate a wide range of compression members. For example, if the compression member is wallboard of a particular size, the gap between alignment guides 104 and 106 could be created to accommodate such a particular compression member. In addition, the alignment guides 104 and 106 could be angled to define a V-shaped wedge which may further assist in retaining the compression member.

The device 90 further includes a slip-resistant bottom 100 which has gripping surfaces 102 defined there-on. The slip-resistant bottom 100 may be made of any material suitable for that purpose, such as various rubber compounds. The gripping surfaces 102 may or may not be specifically provided, but if employed can provide greater resistance to slipping by the device 90. A similar slip-resistant bottom can be employed with any of the devices made in accordance with the present invention. Such slip-resistant bottoms are particularly effective where abutment edges are to be deleted.

Figure 8:
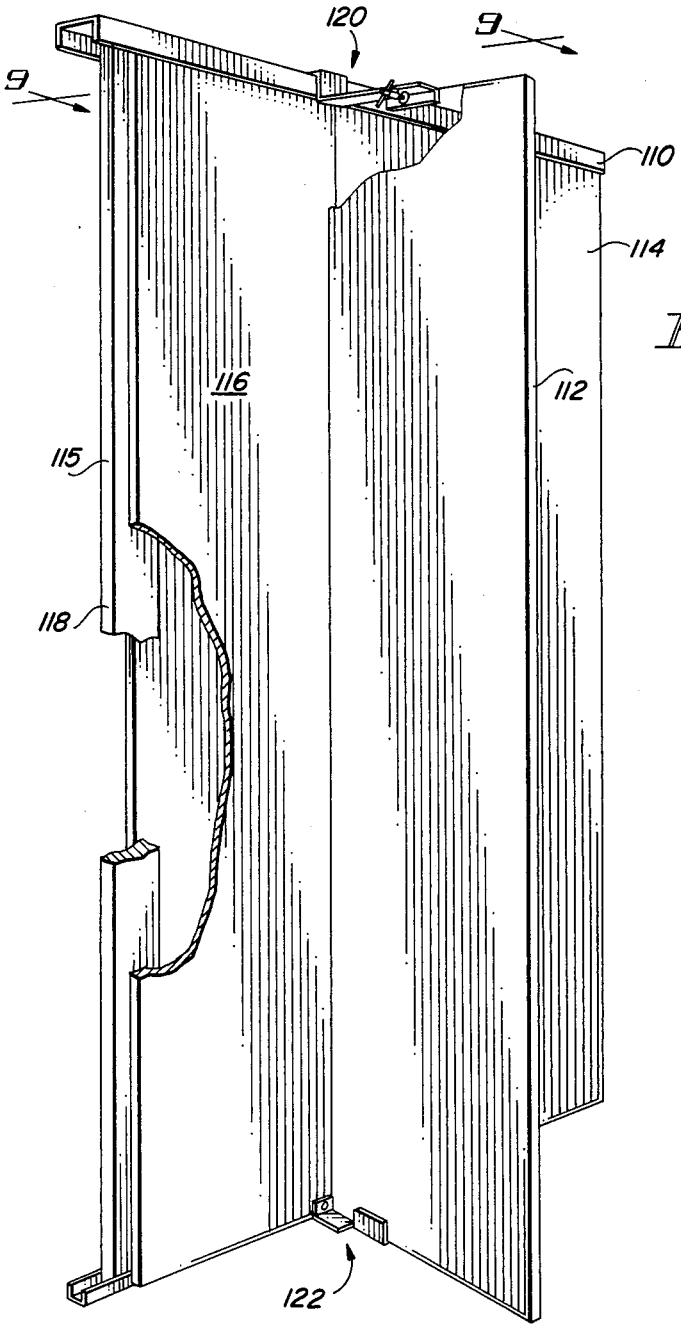
FIG. 8 is a perspective view of an upper and lower device in accordance with the present invention utilized in connection with a wall system having exposed framework.
Figure 9:
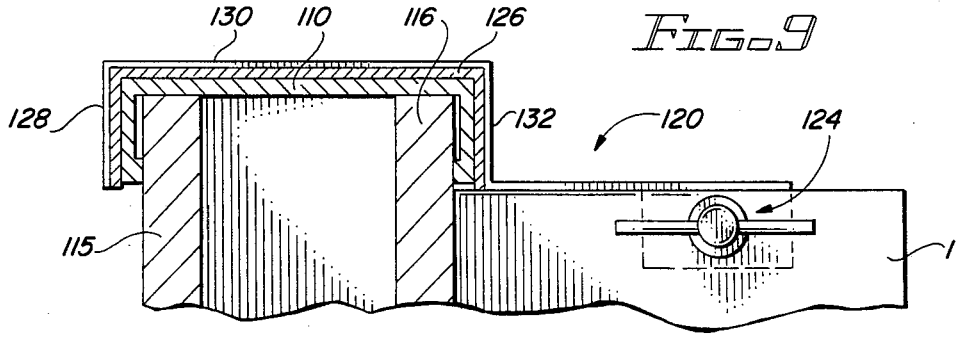
FIG. 9 is a sectional view of a device in accordance with the present invention for use with a wall system having exposed framework.

FIG. 8 illustrates use of a device 120 in accordance with the present invention used in connection with a wall system having an exposed framework. Such wall systems often employ prefinished aluminum headers and frames to support wall coverings. As shown in FIG. 8, a lower device 122 and an upper device 120 are used to hold compression member 112 in relation to wall coverings 114 and 116. As illustrated in FIG. 9, device 120 includes gripping members 128, 130, and 132. The gripping members 128, 130, and 132 are used to engage a header 110 for use of the device 120. To prevent damage to a prefinished header 110, a padded layer 126 may be provided on the inside of the gripping members 128, 130, and 132. A gripping member suitable for use in the present invention may take a variety of forms and may include a retaining means which includes a clamping member. The padded layer 126 may be of any material suitable for that purpose, such as felt or soft rubber. As shown, the device 120 includes a retaining means 124 depicted as a clamping member including a compression screw.

The present invention has been described in connection with specific embodiments. However, it will be apparent to those skilled in the art that variations from the illustrated embodiments may be undertaken without departing from the spirit and scope of the invention. As discussed, various types of retaining means can be provided. The types illustrated include a compression screw, a compression clamp, an end stop, serrations and a spring. Other retaining means could include various clamp retaining means such as C-clamps and vise grips, and a camlock system whereby a cam is twisted by means of a lever into contact with the compression member. In addition, more than one retaining means could be used in a device in accordance with the present invention, with or without the use of an alignment guide. In such case, the retaining means could operate also as an alignment means when holding the compression member in place. These and other variations will be apparent to those skilled in the art in view of the above disclosure and are within the spirit and scope of the invention.

*What is claimed is:*

1. A device for temporarily retaining a compression member against a wall covering, comprising a flat base adapted to be seated on a floor adjacent the wall covering; an upward-standing abutment edge terminating one end of said base, said abutment edge adapted to engage the wall covering; at least one hole provided in said abutment edge for receiving a temporary fastener and temporarily securing said abutment edge against the wall covering; an alignment guide upward-standing from said base in spaced, substantially perpendicular relationship with respect to said abutment edge, for aligning the compression member against the wall convering and said abutment edge; and tension adjustable retaining means secured to said base opposite said alignment guide for retaining the compression member in compression against the wall covering and said abutment edge.

2. The device of claim 1 wherein said tension adjustable retaining means further comprises a clamping member secured to said base opposite said alignment guide in perpendicular relationship with respect to said alignment guide, such that adjustable movement of said clamping member selectively towards and away from said alignment guide is provided in order to retain the compression member between said alignment guide and said clamping member.

3. The device of claim 2 wherein the clamping member includes a compression screw.

4. The device of claim 1 further comprising at least one hole provided in said base for receiving a temporary fastener and securing said base to the floor.

* * * * *